US011450259B2

(12) United States Patent
Zhao et al.

(10) Patent No.: US 11,450,259 B2
(45) Date of Patent: Sep. 20, 2022

(54) DRIVING METHOD AND DRIVING SYSTEM FOR DISPLAY PANEL

(71) Applicants: HKC CORPORATION LiMiTED, Shenzhen (CN); CHONGQING HKC OPTOELECTRONICS TECHNOLOGY CO., LTD., Chongqing (CN)

(72) Inventors: Wenqin Zhao, Chongqing (CN); Wei Chen, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 100 days.

(21) Appl. No.: 16/982,033

(22) PCT Filed: Oct. 31, 2018

(86) PCT No.: PCT/CN2018/112858
§ 371 (c)(1),
(2) Date: Sep. 17, 2020

(87) PCT Pub. No.: WO2020/062396
PCT Pub. Date: Apr. 2, 2020

(65) Prior Publication Data

US 2021/0020093 A1 Jan. 21, 2021

(30) Foreign Application Priority Data

Sep. 30, 2018 (CN) ..... 201811160500.6

(51) Int. Cl.
*G09G 3/20* (2006.01)

(52) U.S. Cl.
CPC ... *G09G 3/2003* (2013.01); *G09G 2300/0452* (2013.01); *G09G 2320/0276* (2013.01)

(58) Field of Classification Search
CPC ..... G09G 3/2003; G09G 2300/0452; G09G 2320/0276
See application file for complete search history.

(56) References Cited

U.S. PATENT DOCUMENTS

2005/0012700 A1* 1/2005 Hara ..... G09G 3/3696 345/89
2007/0146395 A1* 6/2007 Lee ..... G09G 3/2007 345/690

(Continued)

FOREIGN PATENT DOCUMENTS

CN 101025486 A 8/2007
CN 101458907 A 6/2009

(Continued)

OTHER PUBLICATIONS

Wenfei Li, the ISA written comments, dated May 2019, CN.
Wenfei Li the International Search Report, dated May 2019, CN.

*Primary Examiner* — Chanh D Nguyen
*Assistant Examiner* — Ngan T. Pham-Lu

(57) ABSTRACT

The present application discloses a driving method and a driving system for a display panel. The driving method includes: dividing the display panel into two compensation regions in units of sub-pixels; and outputting a driving voltage according to the compensation region which a sub-pixel belongs to.

10 Claims, 9 Drawing Sheets

(56) References Cited

U.S. PATENT DOCUMENTS

| | | | | |
|---|---|---|---|---|
| 2009/0160879 | A1 | 6/2009 | Tu et al. | |
| 2015/0035878 | A1* | 2/2015 | Zhu | G09G 3/3648 345/694 |
| 2016/0125807 | A1* | 5/2016 | Wang | G09G 3/3258 345/205 |
| 2020/0410918 | A1* | 12/2020 | Gai | H01L 27/3227 |

FOREIGN PATENT DOCUMENTS

| | | | |
|---|---|---|---|
| CN | 103517054 | A | 1/2014 |
| CN | 105225647 | A | 1/2016 |
| CN | 106683627 | A | 5/2017 |
| CN | 107068102 | A | 8/2017 |
| CN | 107481689 | A | 12/2017 |
| CN | 107529048 | A | 12/2017 |

* cited by examiner

DRIVING METHOD AND DRIVING SYSTEM FOR DISPLAY PANEL

CROSS REFERENCE OF RELATED APPLICATIONS

The present application claims priority to Chinese Patent Application No. CN201811160500.6, filed with National Intellectual Property Administration, PRC on Sep. 30, 2018, and entitled "DRIVING METHOD AND DRIVING SYSTEM FOR DISPLAY PANEL" Which is incorporated herein by reference in its entirety.

TECHNICAL FIELD

The present application relates to the technical field of display, and in particular, to a driving method and a driving system for a display panel.

BACKGROUND

The statements herein merely provide background information related to the present application and do not necessarily constitute the prior art.

Displays controlled by active switches include a liquid crystal display, an organic light-emitting diode (OLED) display, and the like. The liquid crystal display has many advantages such as thin bodies, power saving and no radiation, and has been widely used. The working principle of a liquid crystal panel is that liquid crystal molecules are placed between two parallel glass substrates and a driving voltage is applied on the two glass substrates to control a rotating direction of the liquid crystal molecules, so as to refract light of a backlight module to generate a picture. The OLED display has many advantages such as self-illumination, short response time, high definition and contrast, flexible display and large-area full-color display. The superior performance and huge market potential of the OLED display have attracted many manufacturers and scientific research institutions all over the world to invest in the production and research and development of OLED display panels.

With the development of the liquid crystal display field, higher image quality has become a main indicator of major display manufacturers. A chroma viewing angle as an important indicator of image quality is an important direction for vertical alignment (VA) type panel manufacturers. The present application can greatly improve a panel aperture ratio and a chroma viewing angle by processing an display image. The display panel will result in a lower transmittance when the resolution is improved.

SUMMARY

An objective of the present application is to provide a driving method and a driving system for a display panel to solve a problem of a low transmittance based on a large viewing angle color shift.

To achieve the above objective, the present application provides a driving method for a display panel, where the display panel includes a multiplicity of pixels, and the pixels each include a plurality of sub-pixels; the driving method includes:

dividing the display panel into two compensation regions in units of sub-pixels;

outputting a driving voltage according to the compensation region which a sub-pixel belongs to;

where at least two sub-pixels in each pixel belong to different compensation regions; the driving Voltage includes a first driving voltage or a second driving voltage, and the first driving voltage is greater than an input voltage; the second driving voltage is smaller than the input voltage; and the input voltage is a voltage required for the corresponding sub-pixel to display normally.

The present application also discloses a driving method for a display panel, where the display panel includes a multiplicity of pixels, and the pixels each include a plurality of sub-pixels; the driving method includes:

dividing the display panel into two compensation regions in units of sub-pixels;

forming a first input voltage after an input voltage is subjected to a primary gamma correction;

forming a second input voltage and a third input voltage after a first input voltage is subjected to a secondary gamma correction; where the second input voltage is greater than the third input voltage;

choosing to output the second input voltage or the third input voltage as a fourth input voltage according to the compensation region which a sub-pixel belongs to;

multiplying the fourth input voltage by a compensation coefficient H_gain. and adding the first input voltage multiplied by (H_gain), to obtain a driving Voltage; where 1>H_gain>0;

where at least two sub-pixels in each pixel belong to different compensation regions; the driving voltage includes a first driving voltage or a second driving voltage, and the first driving voltage is greater than an input voltage; the second driving voltage is smaller than the input voltage; the input voltage is a voltage required for the corresponding sub-pixel to display normally;

two adjacent sub-pixels belong to the two different compensation regions respectively;

a method for acquiring the compensation coefficient includes:

determining the compensation coefficient based on the sub-pixel of a color corresponding to a maximum hue;

a hue difference between minimum compensation coefficients between the sub-pixels corresponding to different colors is 120°; when the maximum hue corresponds to red, if a green hue is greater than a blue hue, the minimum compensation coefficient corresponds to 0° C.; and if the blue hue is greater than the green hue, the minimum compensation coefficient corresponds to 360° C.

The present application also discloses a driving system for a display panel, where the display panel includes:

a multiplicity of pixels; and sub-pixels, where the pixels each include a plurality of sub-pixels;

the driving system includes:

a partition circuit: dividing the display panel into two compensation regions in units of sub-pixels;

a calculation circuit: outputting a driving voltage according to the compensation region which a sub-pixel belongs to;

where at least two sub-pixels in each pixel belong to different compensation regions; the driving voltage includes a first driving voltage or a second driving voltage, and the first driving voltage is greater than an input voltage; the second driving voltage is smaller than the input voltage; and the input voltage is a voltage required for the corresponding sub-pixel to display normally.

The inventor has found that sub-pixel electrodes need to be subjected to partition isolation in a sub-pixel-based partition control mode, to form two independent and mutually conductive regions. Therefore, a weak electric field region is formed between the two regions, reducing the transmittance. The present application performs partition compensation in units of sub-pixels with no need for division of sub-pixels, so that a single sub-pixel is internally a complete electric field, thereby improving the transmittance. Moreover, considering that each pixel includes a plurality of sub-pixels, as long as two sub-pixels are input into different partitions, a first driving voltage corresponding to one of the partitions is greater than an input voltage, while a second driving voltage corresponding to the other partition is smaller than the input voltage. By mixing curves of the two driving voltages, it is still possible to obtain an approximately linear display effect, thereby achieving the purpose of improving a large viewing angle color shift.

BRIEF DESCRIPTION OF DRAWINGS

The drawings are included to provide further understanding of embodiments of the present application, which constitute a part of the specification and illustrate the embodiments of the present application, and describe the principles of the present application together with the text description. Apparently, the accompanying drawings in the following description show merely some embodiments of the present application, and a person of ordinary skill in the art may still derive other accompanying drawings from these accompanying drawings without creative efforts. In the accompanying drawings.

DETAILED DESCRIPTION

Figure 1:
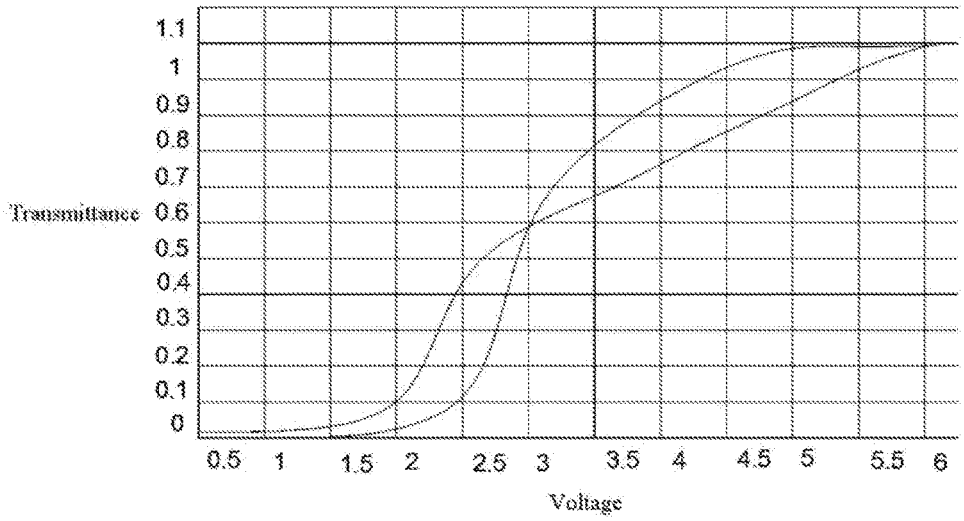
FIG. 1 is a schematic diagram of characteristic curves of a voltage and a transmittance according to the present application.

The specific structure and function details disclosed herein are merely representative, and are intended to describe exemplary embodiments of the present application. However, the present application can be specifically embodied in many alternative forms, and should not be interpreted to be limited to the embodiments described herein.

In the description of the present application, it should be understood that, orientation or position relationships indicated by the terms "center", "transversal", "upper", "lower", "left", "right", "vertical", "horizontal", "top", "bottom", "inner", "outer", etc. are based on the orientation or position relationships as shown in the drawings, for ease of the description of the present application and simplifying the description only, rather than indicating or implying that the indicated device or element must have a particular orientation or be constructed and operated in a particular orientation. Therefore, these terms should not be understood as a limitation to the present application. In addition, the terms such as "first" and "second" are merely for a descriptive purpose, and cannot be understood as indicating or implying a relative importance, or implicitly indicating the number of the indicated technical features. Hence, the features defined by "first" and "second" can explicitly or implicitly include one or more features. In the description of the present application, "a plurality of" means two or more, unless otherwise stated. In addition, the term "include" and any variations thereof are intended to cover a non-exclusive inclusion.

In the description of the present application, it should be understood that, unless otherwise specified and defined, the terms "install", "connected with", "connected to" should be comprehended in a broad sense. For example, these terms may be comprehended as being fixedly connected, detachably connected or integrally connected; mechanically connected or electrically connected; or directly connected or indirectly connected through an intermediate medium, or in an internal communication between two elements. The specific meanings about the foregoing terms in the present application may be understood by those skilled in the art according to specific circumstances.

The terms used herein are merely for the purpose of describing the specific embodiments, and are not intended to limit the exemplary embodiments. As used herein, the singular forms "a", "an" are intended to include the plural forms as well, unless otherwise indicated in the context clearly. It will be further understood that the terms "comprise" and/or "include" used herein specify the presence of the stated features, integers, steps, operations, elements and/or components, but do not preclude the presence or addition of one or more other features, integers, steps, operations, elements, components and/or combinations thereof.

With the development of the liquid crystal display field, higher image quality has become a main indicator of major display manufacturers. In a vertical alignment panel, a chroma viewing angle as an important indicator of image quality is an important direction for panel manufacturers. The present application can greatly improve a panel aperture ratio and a chroma viewing angle by processing an display image. Generally, a phenomenon that the display panel is white when a viewing angle exceeds 45° leftwards or rightwards is obvious.

Referring to FIG. 1, the reason for the whiteness of the display panel is that under a large viewing angle, a V-T curve drift causes the contrast of a picture to decrease, and the phenomenon of whiteness occurs.

Figure 2:
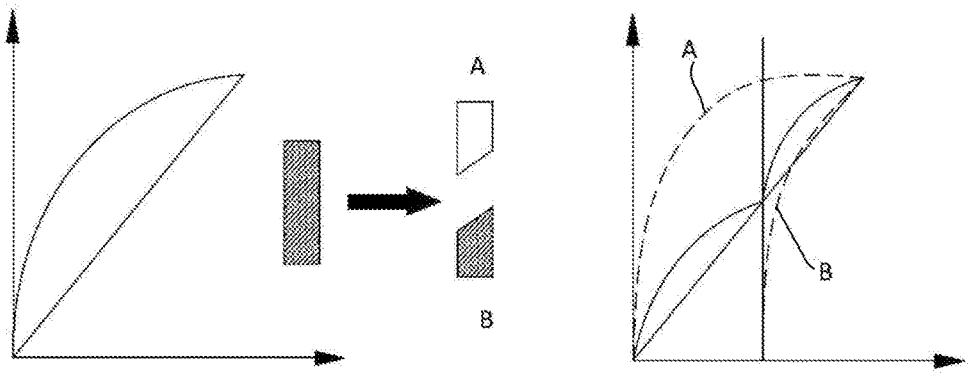
FIG. 2 is a schematic diagram of a sub-pixel-based partition compensation method according to the present application.

Referring to FIG. 2, the applicant uses an undisclosed technical solution to solve the large viewing, angle color shift problem. Taking green as an example, each sub-pixel is split into two parts, A and B, and then A and B are mixed to make a green curve approximately linear to improve the large viewing angle color. However, such a pixel partitioning will lead to a decrease in transmittance in the case of improved resolution.

The present application will be further described below with reference to the accompanying drawings and optional embodiments.

Figure 3:
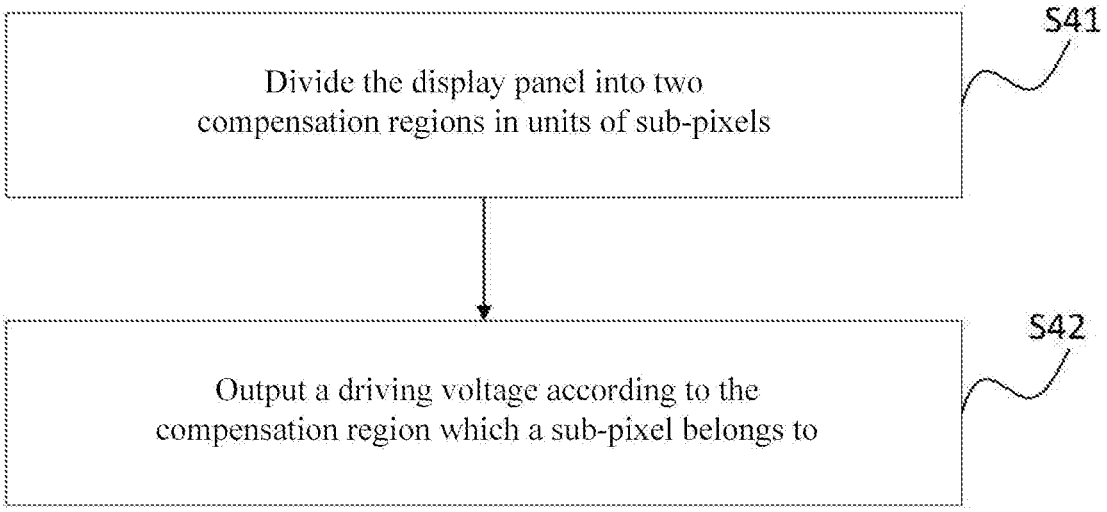
FIG. 3 is a schematic flow chart of a driving method according to an embodiment of the present application.

Referring to FIG. 3, the present application discloses a driving method for a display panel, where the display panel includes a multiplicity of pixels, and the pixels each include a plurality of sub-pixels; the driving method includes:

S31: Divide the display panel into two compensation regions in units of sub-pixels.

S32: Output a driving voltage according to the compensation region which a sub-pixel belongs to.

At least two sub-pixels in each pixel belong to different compensation regions; the driving voltage includes a first driving voltage or a second driving voltage, and the first driving voltage is greater than an input voltage; the second driving voltage is smaller than the input voltage; and the input voltage is a voltage required for the corresponding sub-pixel to display normally.

The inventor has found that sub-pixel electrodes need to be subjected to partition isolation in a sub-pixel-based partition control mode, to form two independent and mutually conductive regions. Therefore, a weak electric field region is formed between the two regions, reducing the transmittance. The present application performs partition, compensation in units of sub-pixels with no need for division of sub-pixels, so that a single sub-pixel is internally a complete electric field, thereby improving the transmittance. Moreover, considering that each pixel includes a plurality of sub-pixels, as long as two sub-pixels are input into different partitions, a first driving voltage corresponding to one of the partitions is greater than an input voltage, while a second driving voltage corresponding to the other partition is smaller than the input voltage. By mixing curves of the two driving voltages, it is still possible to obtain an approximately linear display effect, thereby achieving the purpose of improving a large viewing angle color shift.

Figure 4:
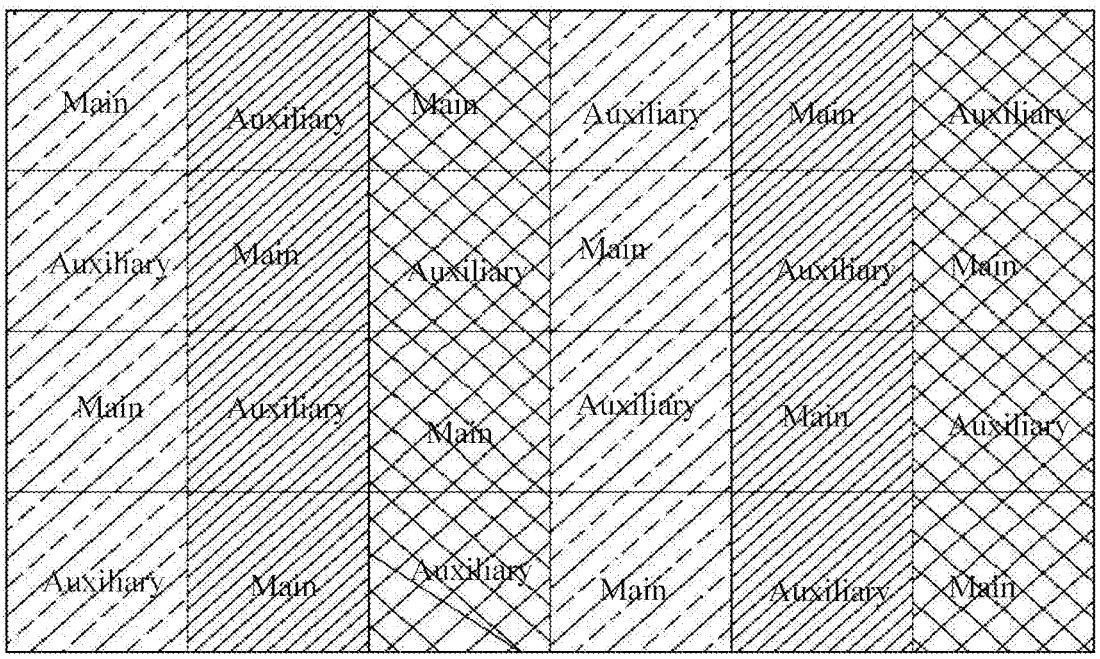
FIG. 4 is a schematic diagram of a compensation partition of a driving method according to an embodiment of the present application.

Referring to FIG. 4, in an embodiment, two adjacent sub-pixels belong to the two different compensation regions respectively. Taking pixels of three primary colors as an example, each of the pixels 100 includes three sub-pixels of red, green, and blue, and main sub-pixels 110 and auxiliary sub-pixels 120 in the figure correspond to two different compensation regions respectively.

Figure 5:
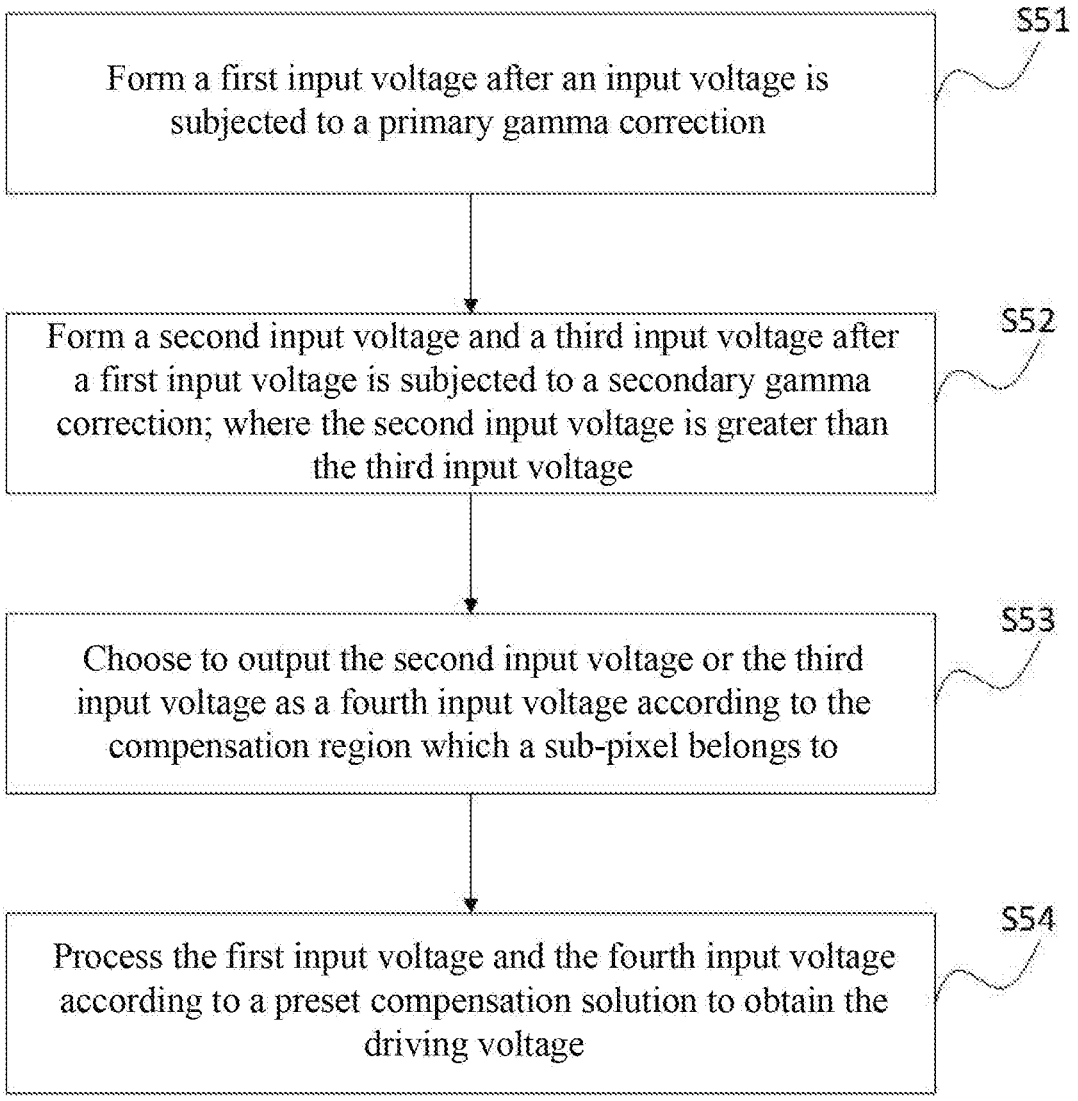
FIG. 5 is a schematic flow chart of another driving method according to an embodiment of the present application.
Figure 10:
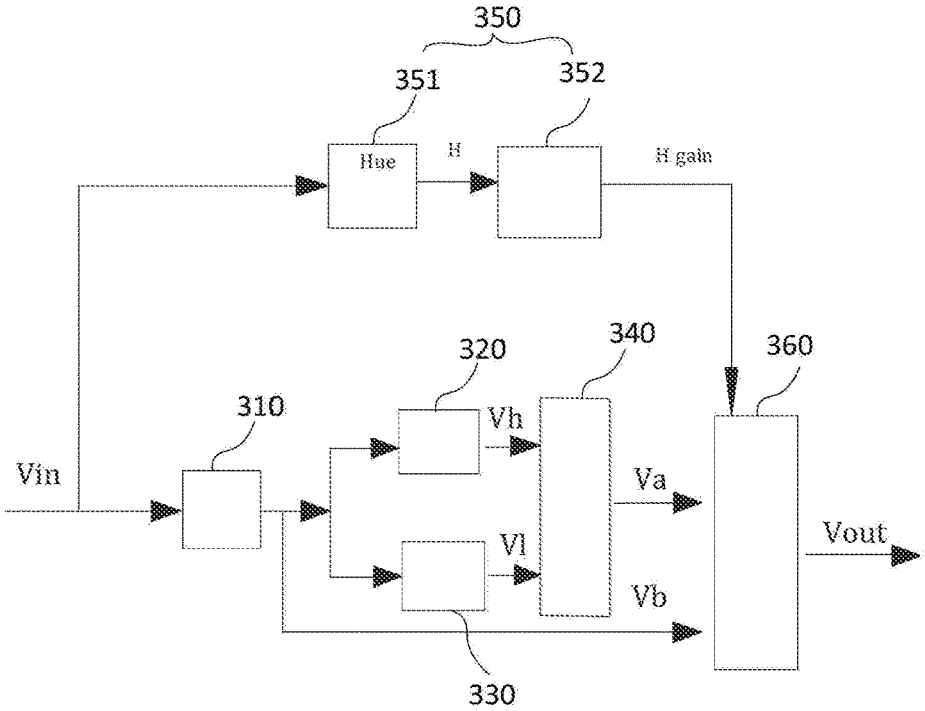
FIG. 10 is a schematic diagram of a principle of a calculation circuit according to an embodiment of the present application.

Referring to FIG. 5 and FIG. 10, in an embodiment, the step of outputting a compensation voltage according to the compensation region which a sub-pixel belongs to includes:

S51: Form a first input voltage Vb after an input voltage Vin is subjected to a primary gamma correction.

S52: Form a second input voltage Vh and a third input voltage Vl after a first input voltage Vb is subjected to a secondary gamma correction; where the second input voltage Vh is greater than the third input voltage Vl.

S53: Choose to output the second input voltage Vh or the third input voltage Vl as a fourth input voltage Va according to the compensation region which a sub-pixel belongs to.

S54: Process the first input voltage Vb and the fourth input voltage Va according to a preset compensation solution to obtain the driving voltage.

Each display panel requires a gamma correction, so a driving voltage is formed on the basis of the gamma correction, and an implementation is relatively simple. Moreover, a first input voltage represents an original gamma-corrected driving voltage. With this as a reference, combined with the fourth input voltage calculated in the present application, a compensation effect is closer to an actual situation, and the compensation effect can be effectively improved.

Figure 6:
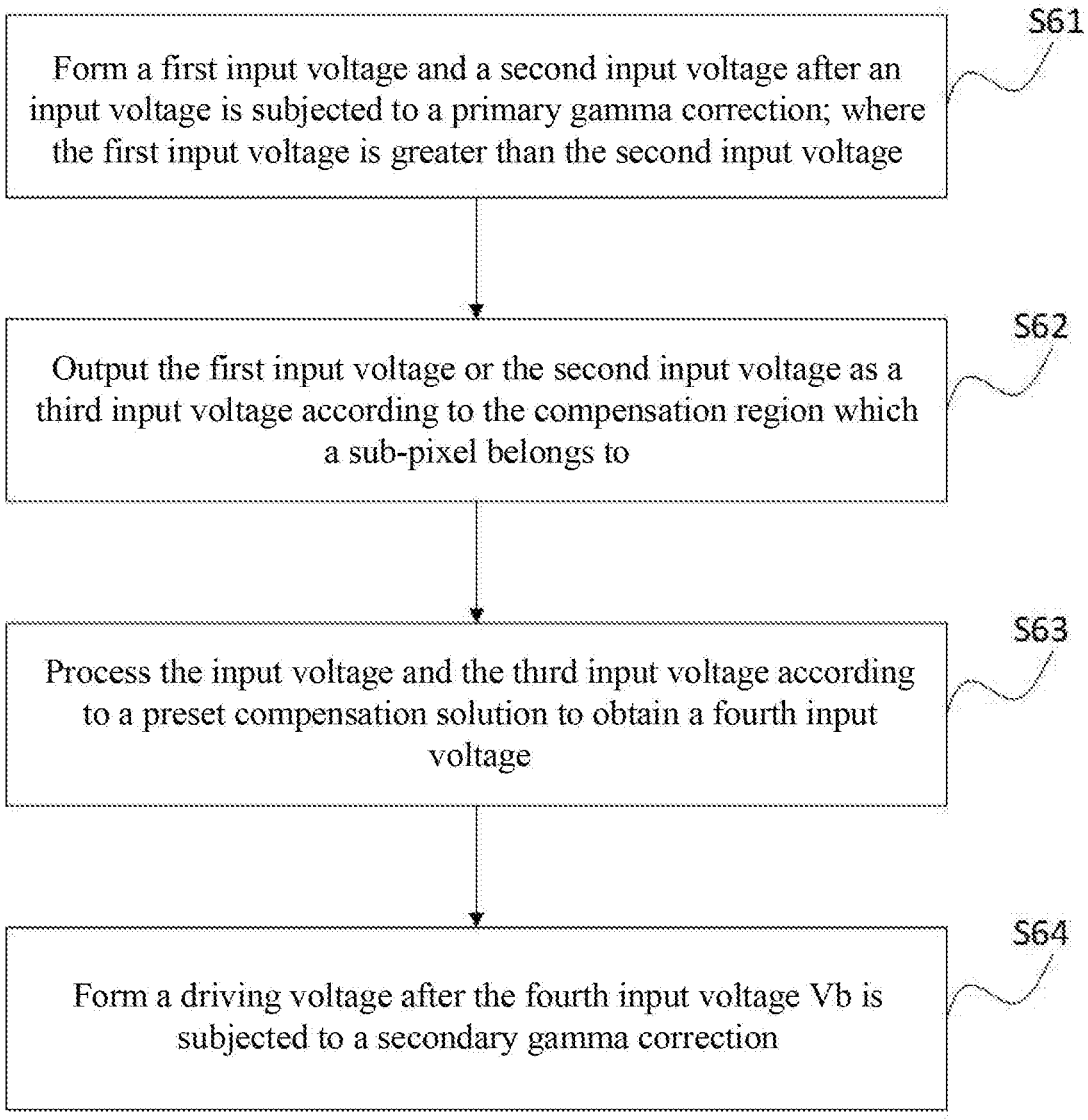
FIG. 6 is a schematic flow chart of another driving method according to an embodiment of the present application.
Figure 11:
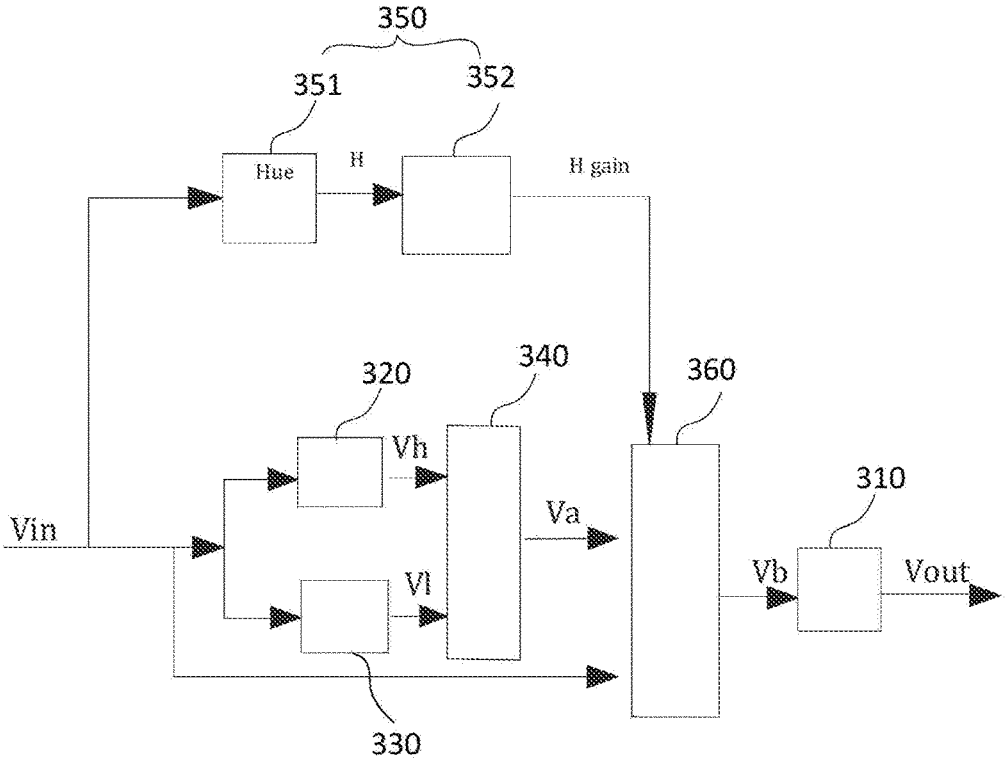
FIG. 11 is a schematic diagram of a principle of another calculation circuit according to an embodiment of the present application.

Referring to FIG. 6 and FIG. 11, in an embodiment, the step of outputting a compensation voltage according to the compensation region which a sub-pixel belongs to includes:

S61: Form a first input voltage Vh and a second input voltage Vl after an input voltage Vin is subjected to a primary gamma correction; where the first input voltage Vh is greater than the second input voltage Vl.

S62: Output the first input voltage Vh or the second input voltage Vl as a third input voltage Va according to the compensation region which a sub-pixel belongs to.

S63: Process the input voltage Vin and the third input voltage Va according to a preset compensation solution to obtain a fourth input voltage Vb.

S64: Form a driving voltage Vout after the fourth input voltage Vb is subjected to a secondary gamma correction.

Each display panel is subjected to gamma corrections. A primary gamma correction is performed on the input voltage first, and then a compensation is carried out in conjunction with the input voltage. Since collected data is relatively initial data, the accuracy is high, and finally a secondary gamma correction is performed, so that an compensation effect can be effectively improved.

In an embodiment, the compensation solution includes:

multiplying a fourth input voltage by a compensation coefficient H_gain, and adding a first input voltage multiplied by (H_gain), to obtain a driving voltage; where 1>H_gain>0.

The compensation coefficient is less than 1, and weights of the first input voltage and the fourth input voltage can be adjusted according to actual conditions, to facilitate later debugging and modification, so as to improve a compensation effect.

In an embodiment, the compensation solution includes a method for acquiring the compensation coefficient that includes:

determining the compensation coefficient based on the sub-pixel of a color corresponding to a maximum hue;

where a hue difference between minimum compensation coefficients between the sub-pixels corresponding to different colors is 120° C.

Hue corrections corresponding to different colors are different, and a color corresponding to a sub-pixel with a maximum hue has the greatest influence on a display effect of the entire pixel. Therefore, the compensation coefficient is determined based on the sub-pixel of the color corresponding to the maximum hue, which can minimize a compensation error and improve the display effect. This solution is applicable to a pixel structure corresponding to the three primary colors. Calculated by 360°, each color differs by 120°, which is convenient for a value of the compensation coefficient.

In an embodiment, when the maximum hue corresponds to red, if a green hue is greater than a blue hue, the minimum compensation coefficient corresponds to 0°; and if the blue hue is greater than the green hue, the minimum compensation coefficient corresponds to 360°.

Generally, corresponding sub-pixels of red are located at the edge of each pixel, and the display effect has an influence on two adjacent pixels. Therefore, the sub-pixel hues at both sides should be comprehensively considered to improve the compensation effect.

A formula for calculating a hue H is as follows:

$$\text{If } (\max(R, G, B)=R) \quad (1)$$

$$\text{If } (G \geq B)$$

$$H=60*(G-B)/(\max(R, G, B)-\min(R, G, B))$$

$$\text{If } (G<B)$$

$$H=360-60*(B-G)/(\max(R, G, B)-\min(R, G, B))$$

$$\text{If } (\max(R, G, B)=G) \quad (2)$$

$$H=120+60*(B-R)/(\max(R, G, B)-\min(R, G, B))$$

$$\text{If } (\max(R, G, B)=B) \quad (3)$$

$$H=240+60*(R-G)/(\max(R, G, B)-\min(R, G, B))$$

Figure 7:
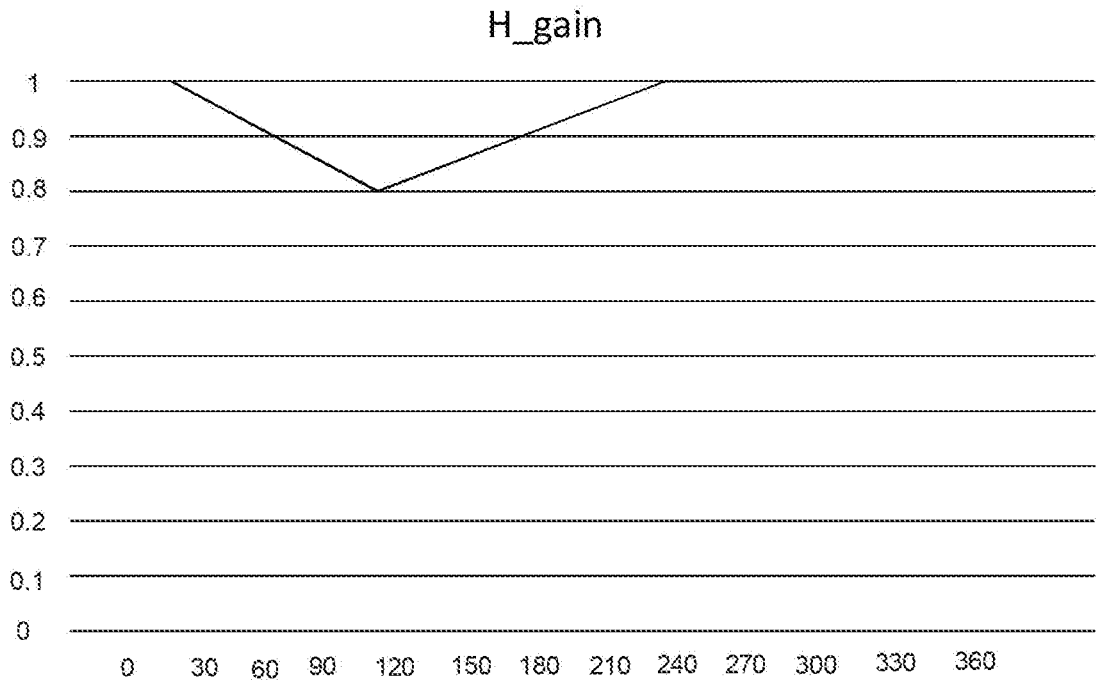
FIG. 7 is a schematic diagram of values of a compensation coefficient based on green according, to an embodiment of the present application.

The compensation coefficient H_gain corresponding to different hues is output according to the hue H. FIG. 7 shows an example of reducing a Va weight for green. H is equal to 120 degrees for a green system. When H=120°, the H_gain is lowered. According to a result of a compensation coefficient acquisition circuit, weights of Va and Vb are determined according to the H_gain factor, where Vo=Va*H_gain+Vb*(1−H_gain).

In an embodiment, the step of outputting a compensation voltage according to the compensation region which a sub-pixel belongs to includes:

forming a first input voltage after an input voltage is subjected to a primary gamma correction;

forming a second input voltage and a third input voltage after a first input voltage is subjected to a secondary gamma correction;

choosing to output the second input voltage as a first input voltage according to the compensation region which a sub-pixel belongs to; or selecting the third input voltage as a second driving voltage.

Each display panel requires a gamma correction, so two driving voltages of different intensities are formed on the basis of directly utilizing the gamma correction, and an implementation is relatively simple.

Figure 8:
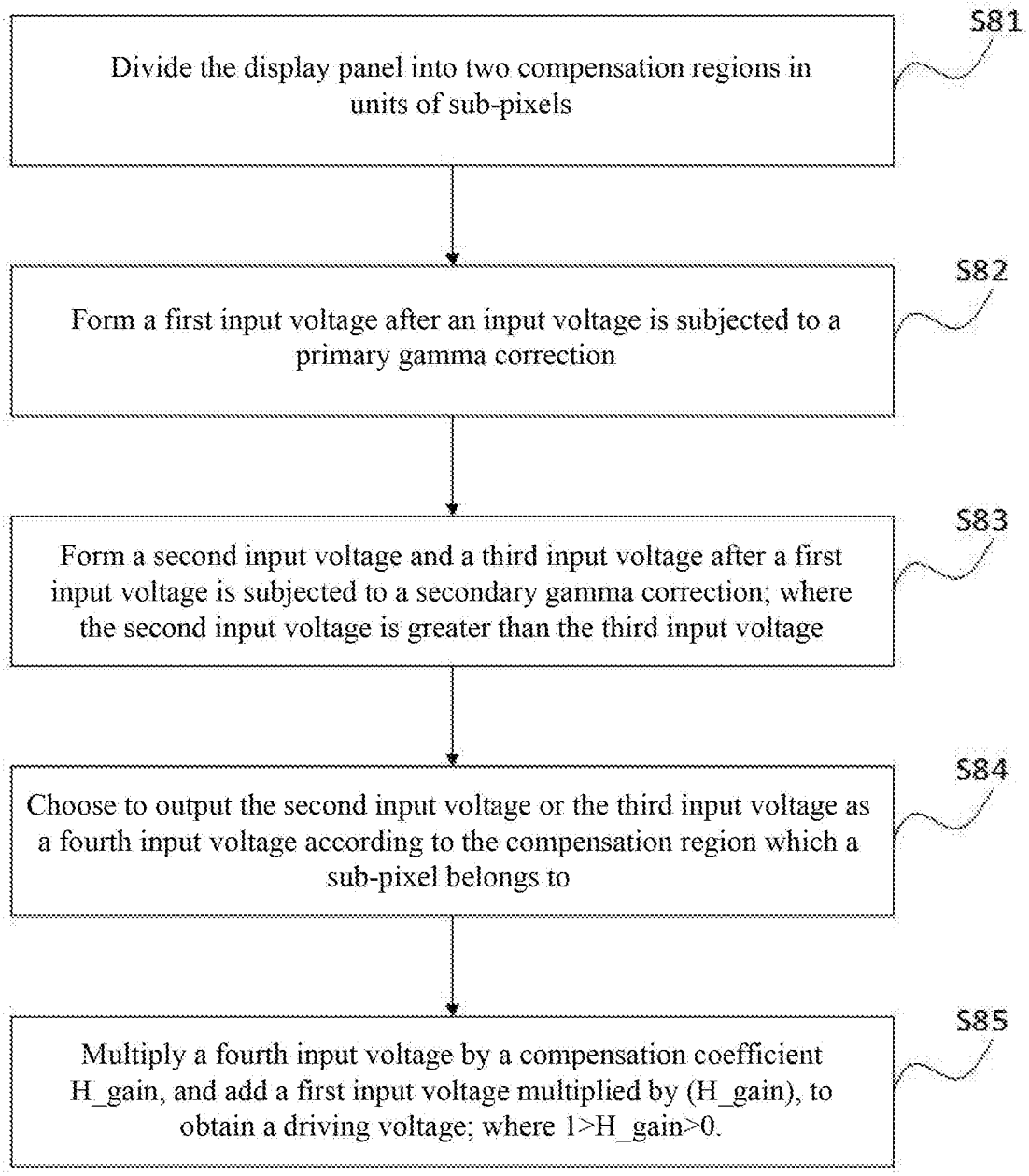
FIG. 8 is a schematic flow chart of another driving method according to an embodiment of the present application.

As another embodiment of the present application, referring to FIG. 8, a driving method for a display panel is disclosed, where the display panel includes a multiplicity of pixels, and the pixels each include a plurality of sub-pixels; the driving method includes:

S81: Divide the display panel into two compensation regions in units of sub-pixels.

S82: Form a first input voltage after an input voltage is subjected to a primary gamma correction.

S83: Form a second input voltage and a third input voltage after a first input voltage is subjected to a secondary gamma correction; where the second input voltage is greater than the third input voltage.

S84: Choose to output the second input voltage or the third input voltage as a fourth input voltage according to the compensation region which a sub-pixel belongs to.

S85: Multiply the fourth input voltage by a compensation coefficient H_gain, and add the first input voltage multiplied by (H_gain), to obtain a driving voltage; where 1>H_gain>0.

At least two sub-pixels in each pixel belong to different compensation regions; the driving voltage includes a first driving voltage or a second driving voltage, and the first driving voltage is greater than an input voltage; the second driving voltage is smaller than the input voltage; the input voltage is a voltage required for the corresponding sub-pixel to display normally.

two adjacent sub-pixels belong to the two different compensation regions respectively;

a method for acquiring the compensation coefficient includes:

determining the compensation coefficient based on the sub-pixel of a color corresponding to a maximum hue;

a hue difference between minimum compensation coefficients between the sub-pixels corresponding to different colors is 120° C.; when the maximum hue corresponds to red, if a green hue is greater than a blue hue, the minimum compensation coefficient corresponds to 0° C.; and if the blue hue is greater than the green hue, the minimum compensation coefficient corresponds to 360°.

A formula for calculating a hue H is as follows:

$$\text{If } (\max(R, G, B)=R) \quad (1)$$

$$\text{If } (G \geq B)$$

$$H=60*(G-B)/(\max(R, G, B)-\min(R, G, B))$$

$$\text{If } (G<B)$$

$$H=360-60*(B-G)/(\max(R, G, B)-\min(R, G, B))$$

$$\text{If } (\max(R, G, B)=G) \quad (2)$$

$$H=120+60*(B-R)/(\max(R, G, B)-\min(R, G, B))$$

$$\text{If } (\max(R, G, B)=B) \quad (3)$$

$$H=240+60*(R-G)/(\max(R, G, B)-\min(R, G, B))$$

The compensation coefficient H_gain corresponding to different hues is output according to the hue H. FIG. 7 shows an example of reducing a Va weight for green. H is equal to 120 degrees for a green system. When H=120°, the H_gain is lowered. According to a result of a compensation coefficient acquisition circuit, weights of Va and Vb are determined according to the H_gain factor, where Vo=Va*H_gain+Vb*(1−H_gain).

Figure 9:
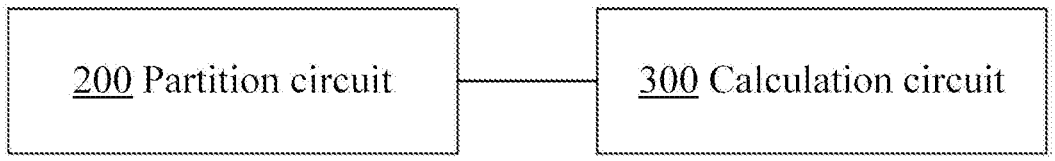
FIG. 9 is a schematic diagram of a principle of a driving system for a display panel according to an embodiment of the present application.

As another embodiment of the present application, references are made to FIG. 4 and FIG. 9. This embodiment discloses a driving system for a display panel, where the display panel includes:

a multiplicity of pixels 100; and sub-pixels 110, where the pixels each include a plurality of sub-pixels 110;

the driving system includes:

a partition circuit 200, where the partition circuit divides into two compensation regions in units of sub-pixels; and a calculation circuit 300, where the calculation circuit outputs a driving voltage according to the compensation region which a sub-pixel belongs to;

at least two sub-pixels in each pixel belong to different compensation regions; the driving voltage includes a first driving voltage or a second driving voltage, and the first driving voltage is greater than an input voltage; the second driving voltage is smaller than the input voltage; and the input voltage is a voltage required for the corresponding sub-pixel to display normally.

Referring to FIG. 10, in an embodiment, the calculation circuit includes:

a gamma circuit 310 that is connected to the input voltage, and outputs a first input voltage;

a first gamma circuit 320 that is connected to the first input voltage, acid outputs a second input voltage;

a second gamma circuit 330 that is connected to the first input voltage and outputs a third input voltage; where the second input voltage is greater than the third input voltage;

a first selection circuit 340 that is connected to the second input voltage and the third input voltage, and chooses to output the second input voltage or the third input voltage as a fourth input voltage according to the compensation region which a sub-pixel belongs to;

a compensation circuit 350 that includes:

a hue calculation circuit 351 that is connected to the input voltage, and outputs a hue value of a corresponding sub-pixel; and a compensation coefficient acquisition circuit 352 that acquires the hue value from the hue calculation circuit, and outputs a compensation coefficient; and a second selection circuit 360 that is connected to the compensation coefficient acquisition circuit, the first input voltage and the fourth input voltage, respectively, and outputs the driving voltage.

Hue corrections corresponding to different colors are different, and a color corresponding to a sub-pixel with a maximum hue has the greatest influence on a display effect of the entire pixel. Therefore, the compensation coefficient is determined based on the sub-pixel of the color corresponding to the maximum hue, which can minimize a compensation error and improve the display effect.

The gamma circuit 310 is a white balance circuit component commonly used in a timing control circuit (TCON), with a main purpose of adjusting color coordinates of the panel to achieve desired color coordinates.

The first gamma circuit 320 stores therein a table circuit of an input and output correspondence of main sub-pixels.

The second gamma circuit 330 stores therein a table circuit of an input and output correspondence of auxiliary sub-pixels.

The first selection circuit 340 selects Vh or Vl according to the arrangement of the main sub-pixels and the auxiliary sub-pixel described in FIG. 3, where the main sub-pixels select Vh, and the auxiliary sub-pixels select Vl.

A formula for calculating a hue H by the hue calculation circuit 351 is as follows:

$$\text{If } (\max(R, G, B)=R) \quad (1)$$

$$\text{If } (G \geq B)$$

$$H=60*(G-B)/(\max(R, G, B)-\min(R, G, B))$$

$$\text{If } (G<B)$$

$$H=360-60*(B-G)/(\max(R, G, B)-\min(R, G, B))$$

$$\text{If } (\max(R, G, B)=G) \quad (2)$$

$$H=120+60*(B-R)/(\max(R, G, B)-\min(R, G, B))$$

$$\text{If } (\max(R, G, B)=B) \quad (3)$$

$$H=240+60*(R-G)/(\max(R, G, B)-\min(R, G, B))$$

The compensation coefficient acquisition circuit outputs the compensation coefficient H_gain corresponding to different hues according to the hue H. FIG. 7 shows an example of reducing a Va weight for green. H is equal to 120 degrees for a green system. When H=120°, the H_gain is lowered. According to a result of the compensation coefficient acquisition circuit, the second selection circuit determines weights of Va and Vb according to the H_gain factor, where Vo=Va*H_gain+Vb*(1−H_gain).

Referring to FIG. 11, in an embodiment, the difference from FIG. 8 is that the gamma circuit is moved to an output end of the second selection circuit.

Each display panel needs to be subjected to gamma corrections. A primary gamma correction is performed on the input voltage first, and then a compensation is carried out in conjunction with the input voltage. Since collected data is relatively initial data, the accuracy is high, and finally a secondary gamma correction is performed, so that an compensation effect can be effectively improved.

Figure 12:
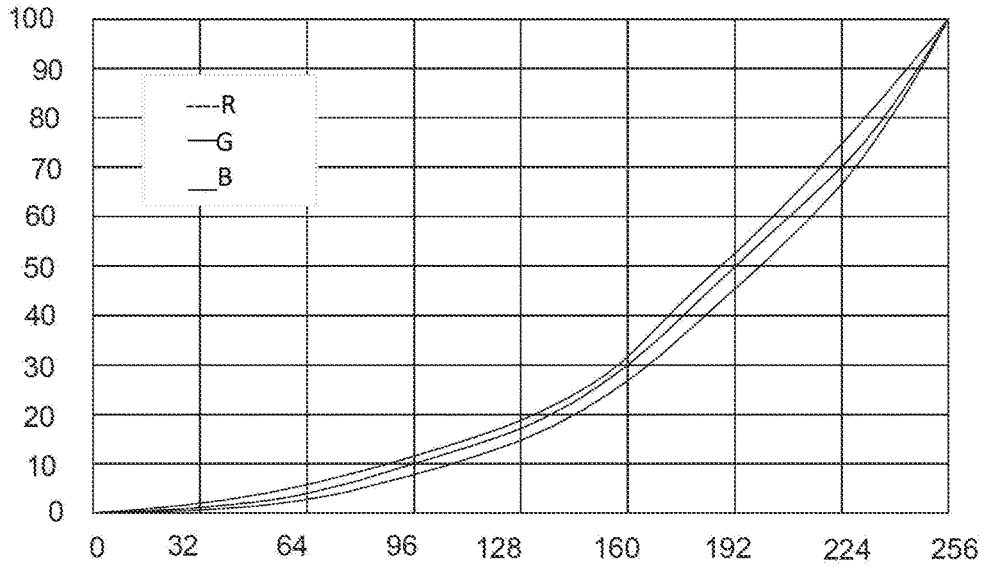
FIG. 12 is a schematic diagram of a gamma compensation curve according to an embodiment of the present application.
Figure 13:
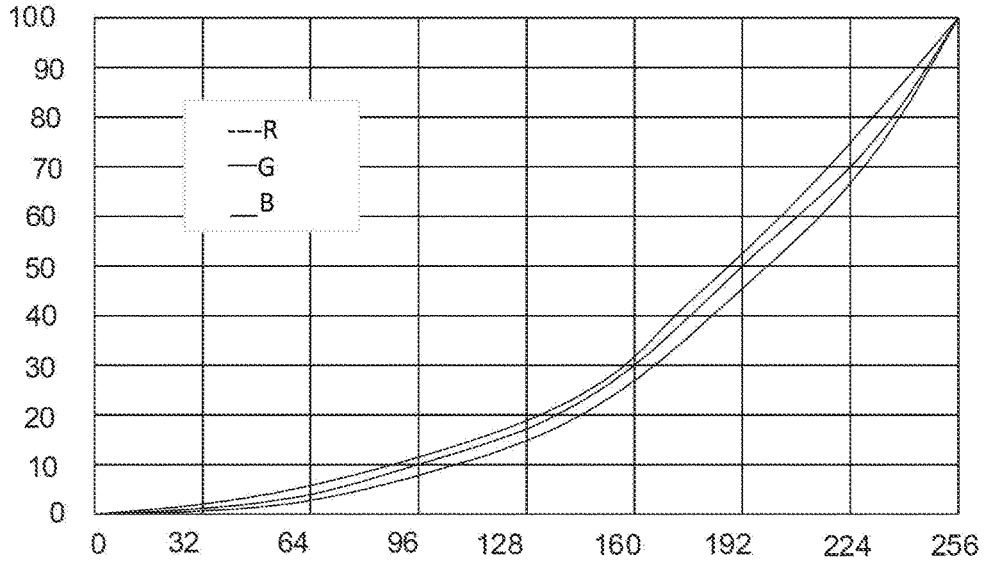
FIG. 13 is a schematic diagram of a white balance based gamma compensation curve according to an embodiment of the present application.
Figure 14:
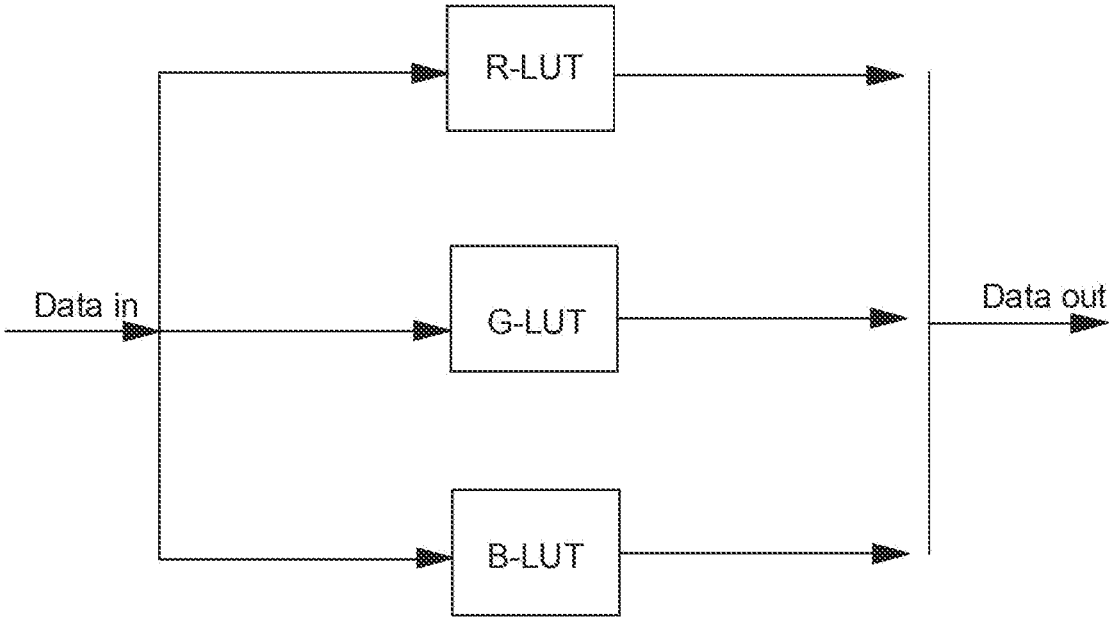
FIG. 14 is a schematic diagram of a gamma compensation based on table lookup according to an embodiment of the present application.

A main function of the gamma circuit is, as shown in FIG. 12 to FIG. 14 below, to adjust white point color coordinates of the panel through an R lookup table, a G lookup table and a B lookup table.

A hardware architecture of the first gamma circuit is also similar to the gamma circuit, and corresponding gray scale values of main sub-pixels higher than a display gray scale are obtained by an R lookup table, a G lookup table and a B lookup table.

A hardware architecture of the second gamma circuit is also similar to the gamma circuit, and corresponding gray scale values of auxiliary sub-pixels lower than a display gray scale are obtained by an R lookup table, a G lookup table and a B lookup table.

Figure 15:
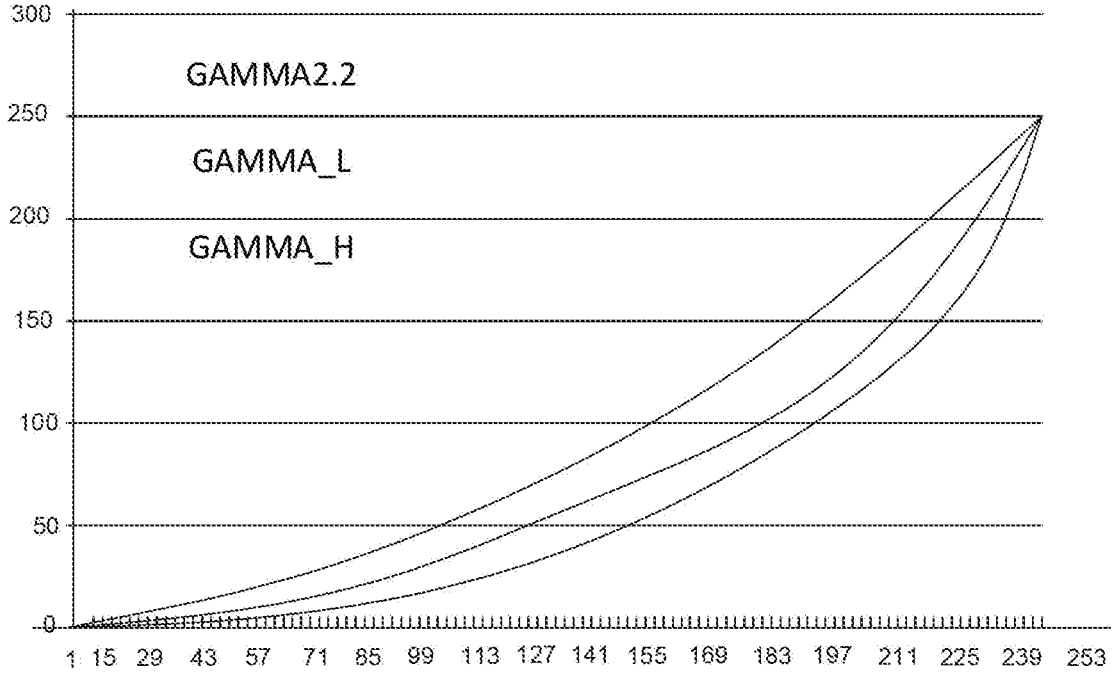
FIG. 15 is a schematic diagram of curves of three gamma compensations according to an embodiment of the present application.

The R, G, and B lookup tables of the first gamma circuit and the R, G, and B lookup tables of the second gamma circuit need to follow the rule, referring to FIG. 15, that a target gamma curve is formed by mixing a first lookup table and a second lookup table, taking a target curve being 2.2 as an example.

The panel of the present application may be a twisted nematic (TN) panel, an in-plane switching (IPS) panel, a vertical alignment (VA) panel, or a multi-domain vertical alignment (MVA) panel, and of course, the panel may also be other types of panels, as long as the panels are suitable.

The above are further detailed descriptions of the present application in conjunction with the specific optional embodiments, but the specific implementation of the present application cannot be determined as limited to these descriptions. For a person of ordinary skill in the art to which the present application pertains, a number of simple deductions or substitutions may also be made without departing from the concept of the present application. All these should be considered as falling within the scope of protection of the present application.

What is claimed is:

1. A driving method for a display panel, wherein the display panel comprises a plurality of pixels, and the pixels each comprise a plurality of sub-pixels; the driving method comprises:

dividing the display panel into two compensation regions in units of sub-pixels; and outputting a driving voltage according to the compensation region which a sub-pixel belongs to;

wherein at least two sub-pixels in each pixel belong to different compensation regions; the driving voltage comprises a first driving voltage or a second driving voltage, and the first driving voltage is greater than an input voltage; the second driving voltage is smaller than the input voltage; and the input voltage is a voltage required for the corresponding sub-pixel to display normally;

wherein the step of outputting a compensation voltage according to the compensation region which a sub-pixel belongs to comprises:

forming a first input voltage after an input voltage is subjected to a primary gamma correction;

forming a second input voltage and a third input voltage after a first input voltage is subjected to a secondary gamma correction; wherein the second input voltage is greater than the third input voltage;

choosing to output the second input voltage or the third input voltage as a fourth input voltage according to the compensation region which a sub-pixel belongs to; and processing the first input voltage and the fourth input voltage according to a preset compensation solution to obtain the driving voltage;

wherein the compensation solution comprises:

multiplying a fourth input voltage by a compensation coefficient H_gain, and adding a first input voltage multiplied by (H_gain), to obtain a driving voltage; wherein 1>H_gain>0.

2. The driving method for a display panel according to claim 1, wherein two adjacent sub-pixels belong to the two different compensation regions respectively.

3. The driving method for a display panel according to claim 1, wherein the compensation solution comprises a method for acquiring the compensation coefficient that comprises:

determining the compensation coefficient based on the sub-pixel of a color corresponding to a maximum hue;

wherein a hue difference between minimum compensation coefficients between the sub-pixels corresponding to different colors is 120°.

4. The driving method for a display panel according to claim 3, wherein when the maximum hue corresponds to red, if a green hue is greater than a blue hue, the minimum compensation coefficient corresponds to 0°; and if the blue hue is greater than the green hue, the minimum compensation coefficient corresponds to 360°.

5. A driving method for a display panel, wherein the display panel comprises a multiplicity of pixels, and the pixels each comprise a plurality of sub-pixels; the driving method comprises:

dividing the display panel into two compensation regions in units of sub-pixels; and forming a first input voltage after an input voltage is subjected to a primary gamma correction;

forming a second input voltage and a third input voltage after a first input voltage is subjected to a secondary gamma correction; wherein the second input voltage is greater than the third input voltage;

choosing to output the second input voltage or the third input voltage as a fourth input voltage according to the compensation region which a sub-pixel belongs to;

multiplying the fourth input voltage by a compensation coefficient H_gain, and adding the first input voltage multiplied by (H_gain), to obtain a driving voltage; wherein 1>H_gain>0;

at least two sub-pixels in each pixel belong to different compensation regions; the driving voltage comprises a first driving voltage or a second driving voltage, and the first driving voltage is greater than an input voltage; the second driving voltage is smaller than the input voltage; the input voltage is a voltage required for the corresponding sub-pixel to display normally.

two adjacent sub-pixels belong to the two different compensation regions respectively;

a method for acquiring the compensation coefficient comprises:

determining the compensation coefficient based on the sub-pixel of a color corresponding to a maximum hue;

a hue difference between minimum compensation coefficients between the sub-pixels corresponding to different colors is 120°; when the maximum hue corresponds to red, if a green hue is greater than a blue hue, the minimum compensation coefficient corresponds to 0°; and if the blue hue is greater than the green hue, the minimum compensation coefficient corresponds to 360°.

6. A driving system for a display panel, wherein the display panel comprises:

a multiplicity of pixels; and sub-pixels, wherein the pixels each comprise a plurality of sub-pixels;

the driving system comprises:

a partition circuit that divides the display panel into two compensation regions in units of sub-pixels; and a calculation circuit that outputs a driving voltage according to the compensation region which a sub-pixel belongs to;

at least two sub-pixels in each pixel belong to different compensation regions; the driving voltage comprises a first driving voltage or a second driving voltage, and the first driving voltage is greater than an input voltage; the second driving voltage is smaller than the input voltage; and the input voltage is a voltage required for the corresponding sub-pixel to display normally;

wherein the calculation circuit is configured to:

form a first input voltage after an input voltage is subjected to a primary gamma correction;

form a second input voltage and a third input voltage after a first input voltage is subjected to a secondary gamma correction; wherein the second input voltage is greater than the third input voltage;

choose to output the second input voltage or the third input voltage as a fourth input voltage according to the compensation region which a sub-pixel belongs to; and process the first input voltage and the fourth input voltage according to a preset compensation solution to obtain the driving voltage;

wherein the compensation solution comprises:

multiplying the fourth input voltage by a compensation coefficient H_gain, and adding the first input voltage multiplied by (H_gain), to obtain a driving voltage; wherein 1>H_gain>0.

7. The driving system for a display panel according to claim 6, wherein the calculation circuit comprises:

a gamma circuit that is connected to the input voltage, and outputs the first input voltage;

a first gamma circuit that is connected to the first input voltage, and outputs the second input voltage;

a second gamma circuit that is connected to the first input voltage and outputs the third input voltage; wherein the second input voltage is greater than the third input voltage;

a first selection circuit that is connected to the second input voltage and the third input voltage, and chooses to output the second input voltage or the third input voltage as the fourth input voltage according to the compensation region which a sub-pixel belongs to;

a compensation circuit, comprising:

a hue calculation circuit that is connected to the input voltage, and outputs a hue value of a corresponding sub-pixel; and a compensation coefficient acquisition circuit that acquires the hue value from the hue calculation circuit, and outputs a compensation coefficient; and a second selection circuit that is connected to the compensation coefficient acquisition circuit, the first input voltage and the fourth input voltage, respectively, and outputs the driving voltage.

8. The driving system for a display panel according to claim 6, wherein two adjacent sub-pixels belong to the two different compensation regions respectively.

9. The driving system for a display panel according to claim 6, wherein the compensation solution comprises a method for acquiring the compensation coefficient that comprises:

determining the compensation coefficient based on the sub-pixel of a color corresponding to a maximum hue;

wherein a hue difference between minimum compensation coefficients between the sub-pixels corresponding to different colors is 120°.

10. The driving system for a display panel according to claim 9, wherein when the maximum hue corresponds to red, if a green hue is greater than a blue hue, the minimum compensation coefficient corresponds to 0°; and if the blue hue is greater than the green hue, the minimum compensation coefficient corresponds to 360°.

* * * * *